US005737952A

United States Patent [19]

Baumann et al.

[11] Patent Number: 5,737,952

[45] Date of Patent: Apr. 14, 1998

[54] METHOD AND APPARATUS FOR PRODUCING A HEADER WITH OPENINGS

[75] Inventors: Rainer Baumann, Vaihingen/Enz; Martin Rilk, Pforzheim, both of Germany

[73] Assignee: Behr GmbH & Co., Stuttgart, Germany

[21] Appl. No.: 708,723

[22] Filed: Sep. 5, 1996

[30] Foreign Application Priority Data

Sep. 6, 1995 [DE] Germany ..... 195 32 860.4

[51] Int. Cl.[6] ..... B21D 28/28

[52] U.S. Cl. ..... 72/55; 72/62; 72/325

[58] Field of Search ..... 72/325, 55, 61, 72/62, 60; 83/53, 54

[56] References Cited

U.S. PATENT DOCUMENTS

| | | | |
|---|---|---|---|
| 3,487,668 | 1/1970 | Fuchs | 83/53 |
| 3,495,486 | 2/1970 | Fuchs | 72/55 |
| 4,621,553 | 11/1986 | Gruchalski | 83/54 |
| 4,763,503 | 8/1988 | Hughes | 72/61 |
| 5,398,533 | 3/1995 | Shimanovski et al. | 72/55 |
| 5,445,002 | 8/1995 | Cudini et al. | 72/62 |
| 5,460,026 | 10/1995 | Schafer | 72/55 |

FOREIGN PATENT DOCUMENTS

| | | |
|---|---|---|
| 198 581 B1 | 2/1986 | European Pat. Off. . |
| 0 588 528 | 3/1994 | European Pat. Off. . |
| 26 96 959 A1 | 10/1993 | France . |
| 40 20 592 A1 | 6/1990 | Germany . |
| 40 35 625 A1 | 11/1990 | Germany . |
| 42 01 422 A1 | 1/1992 | Germany . |
| 43 09 680 A1 | 3/1993 | Germany . |
| 43 22 063 C1 | 7/1993 | Germany . |
| 44 02 020 A1 | 1/1994 | Germany . |
| 43 34 203 | 4/1994 | Germany . |

*Primary Examiner*—Daniel C. Crane
*Attorney, Agent, or Firm*—Foley & Lardner

[57] ABSTRACT

Method and apparatus for forming a tubular heat-exchanger header includes a tool die having a chamber dimensioned to receive the header, the chamber conforming to an outer peripheral contour of the header. A plurality of guide passages are formed through the tool die for insertion of a corresponding number of punches. The guide passages expose the areas of the header to be pierced for forming the openings. The ends of the tubular header are each sealed with a stopper. Fluid is supplied into the header using a fluid supply through one of the stoppers and the pressure is raised to a predetermined internal pressure. While the pressure is maintained, the punches are passed through the guide passages to simultaneously pierce through the header wall to form the openings. The header thus formed has an inwardly directed rim around each opening, which rim sealingly bears against the periphery of the punch to maintain the pressure during piercing. The inwardly directed rim has an insertion slope adapted to guide a heat exchanger tube to be inserted in the opening, and an inner lip extending wider inside the tubular member, which lip provides a solder meniscus. In another embodiment, the rim further includes an outer lip projecting outwardly beyond the peripheral surface of a wall of the header, both the inner and outer lips forming solder meniscuses.

21 Claims, 4 Drawing Sheets

METHOD AND APPARATUS FOR PRODUCING A HEADER WITH OPENINGS

BACKGROUND OF THE INVENTION

EP 0 198 581 B1 describes a heat exchanger having the ends of its parallely extending heat-exchanger tubes received in tubular headers. For purposes of making the connection, slit-shaped openings, into which the ends of the heat exchanger tubes are inserted and soldered to the header, are formed in the wall of the headers. The wall of the header is domed between each adjacent pair of the slit-shaped openings because it is necessary for the material of the header to be drawn far into the header. This allows the header to be adequately positioned against the flat sides of the ends of the heat exchanger tubes. This configuration is, however, possible only when a certain distance exists between the respective heat exchanger tubes. If the distances between neighboring heat exchanger tubes are short, a construction of this type is not possible. Moreover, the contour of the rims, which project into the header and form the slit-shaped openings, is not accurately shaped because when the punches are pressed in to produce the slit-shaped openings, the header is first deformed inwardly, without forming an accurate contour, before it is punctured.

In this regard, producing a tube having a plurality of openings arranged in the tube wall and having inwardly directed rims is known from U.S. Pat. No. 4,679,289, which uses an internal die inserted into a tube to support the same when the punches are pressed in. It is thus possible to produce openings in the tube wall having accurately shaped rims, while the parts of the header lying between neighboring openings correspond to the original tube contour. Because of the multistage die removal process, however, an internal die of this kind must be made in two parts, making the corresponding tool expensive. Moreover, the removal of the internal die, which is carried out in stages following one another, has an effect on the cycle times in the manufacture of a header of this kind.

EP 0 484 789 B1 describes a method of producing an opening in the wall of a workpiece in the form of a hollow body, where the workpiece is inserted into a tool provided with a cavity in the region of the intended opening. The cavity has an edge contour corresponding to the opening to be formed so that, when the workpiece is subjected to a corresponding internal pressure in the hollow space, the workpiece wall is cut into along the edge of the cavity. A method of this kind is, however, not suitable for producing a multiplicity of openings arranged close to one another in a tube wall, and it is even less suitable for producing rims surrounding the openings and directed toward the center of the tube.

SUMMARY OF THE INVENTION

One object of the present invention is, therefore, to provide a method and an apparatus for producing a heat-exchanger header, which can produce accurately shaped openings and rims in simple steps regardless of the cross-sectional shape of the header. According to the present invention, a tubular heat-exchanger header is formed by inserting the tubular header into a tool die having a chamber dimensioned to receive the header. The chamber substantially conforms to an outer peripheral contour of the header. At least one guide passage is formed through the tool die for insertion of the punch, the guide passage exposing an area of the header to be pierced. The ends of the tubular header in the tool die are sealed. Fluid is then supplied into the tubular header through one of the sealed ends. A predetermined internal pressure is applied to the header with the fluid to apply supporting pressure against the wall of the header. Thereafter, the header wall is pierced with the punch while the header is under pressure to prevent deformation of the header. The header can be pressurized between 2 MPa and 50 MPa, more preferably between 4 MPa and 10 MPa.

According to the invention, an inwardly directed rim around the opening is formed during insertion of the punch through the header wall. The pressure in the header is maintained during the piercing step by sealingly bearing the rim against the periphery of the punch. Moreover, an insertion slope, a wider mouth for guiding in a heat exchanger tube to be inserted into the opening, can be formed on the rim with a residual stroke during the piercing of the punch.

To form a plurality of openings in the header, a plurality of guide passages are provided through the tool die for insertion of a corresponding number of punches. The guide passages expose the areas (openings) of the header wall to be pierced. Advantageously, a plurality of openings, which are spaced longitudinally along the header, are simultaneously formed by piercing the exposed header wall areas with the punches while the header is pressurized. Because the header is pressurized and maintained during the piercing step, the header does not become deformed.

According to the invention, an annular ridge extending in the peripheral direction close to each end of the header can be formed by axially compressing an annular element to produce a pressing force acting radially outwardly, which force presses the header wall against a corresponding recess formed in the tool die.

The apparatus according to the invention for forming at least one opening through a tubular heat-exchanger header includes a tool die having a chamber dimensioned to receive the header, the chamber conforming to an outer peripheral contour of the header. It includes at least one punch adapted to pierce a wall of the header. At least one guide passage is formed through the tool die for insertion of the punch, the guide passage exposing an area of the header to be pierced. Seals for sealing each end of the tubular header is provided. A fluid supplier for supplying fluid into the header through one of the seals is provided. The fluid supplier is adapted to apply a predetermined internal pressure to a wall of the header with the fluid. The internal pressure can be between 2 MPa and 50 MPa, more preferably between 4 MPa and 10 MPa, as described before. Again, the opening is formed while the pressure is applied against the header to prevent deformation of the header.

The seals each can comprise a stopper adapted to be inserted axially into one end of the header. In one embodiment, the stopper has a conical peripheral surface formed of a plastic material or rubber material. According to another embodiment, the stopper has a cylindrical shape and has an annular seal. According to another embodiment, the stopper has two end loading elements and an elastic annular element positioned between the two end loading elements, the elastic annular element being radially expandable by the application of an axial force.

The fluid supplier includes a pressure medium line fastened to one of the stoppers and a pressure medium duct communicating with the pressure medium line to an interior of the header.

The punch is adapted produce an inwardly directed rim around the opening during insertion of the punch through the header wall. The pressure in the header is maintained while the punch pierces the header wall by the rim sealingly bearing against the periphery of the punch.

In this regard, the punch preferably has an elongated cross-sectional shape with parallel sides and rounded smaller sides. A front end of the punch has a point having sloping surfaces extending to the rounded smaller sides. The punch further has an axial portion whose parallel sides are slightly shorter than those of a punch stem, and adjoins the sloping surfaces to form a shoulder therebetween. The punch also has a bevel directed toward the point and provided on the sides.

To form a plurality of openings in the header, a plurality of guide passages are formed through the tool die, the guide passages being spaced in the longitudinal direction of the tool die. A corresponding number of punches are provided for piercing the header wall, the guide passages exposing areas (openings) of the header wall to be pierced. Again, the exposed header wall areas are pierced with the punches while the header is pressurized to prevent deformation.

An actuating element connects all of the punches to allow simultaneous movement of the punches for simultaneous formation of the openings. The actuating element preferably is a pressure plate that holds all of the punches.

The tool die preferably comprises an upper member and a lower member, which members are closable to define the chamber. The guide passages are preferably in the upper member, and the upper and lower members part in the longitudinal direction of the header. According to the invention, means for forming an annular ridge extending in the peripheral direction adjacent at least one end of the header is provided. The annular ridge forming means includes an annular element for producing a pressing force acting radially outwardly and at least one recess in the chamber. The annular element presses the header wall against the recess to form the annular ridge. The two-piece tool die allows easy removal of header with the annular ridge or ridges.

A heat exchanger header according to the invention comprises an elongated tubular member having a plurality of longitudinally spaced parallel openings. The openings are spaced apart uniformly, at right angles to the longitudinal direction of the header. The tubular member is cylindrical between the openings without deformation. Each of the openings have an inwardly directed rim, which is adapted to provide a sealing against the periphery of a punch inserted therein. Each of the opening is sickle-shaped over an arc of less than 150°, preferably an arc of about 70°.

The inwardly directed rim has an insertion slope adapted to guide a heat exchanger to be inserted into the opening and an inner lip extending wider inside the tubular member, which lip provides a solder meniscus. According to another embodiment, the rim further includes an outer lip projecting outwardly beyond the peripheral surface of a wall of the header, both the inner and outer lips forming solder meniscuses. The rim can have opposing parallel or arched surfaces adjoining the insertion slope, adapted to bear against the peripheral surface of a heat exchanger tube to be inserted in the opening.

BRIEF DESCRIPTION OF THE DRAWINGS

These and other features, aspects, and advantages of the present invention will become much more apparent from the following description, appended claims, and accompanying exemplary embodiments shown in the drawings.

FIG. 1 shows a detail of a tool die in which a header has been inserted, before the punches are pressed in.

DETAILED DESCRIPTION OF THE PREFERRED EMBODIMENTS

Figure 1:
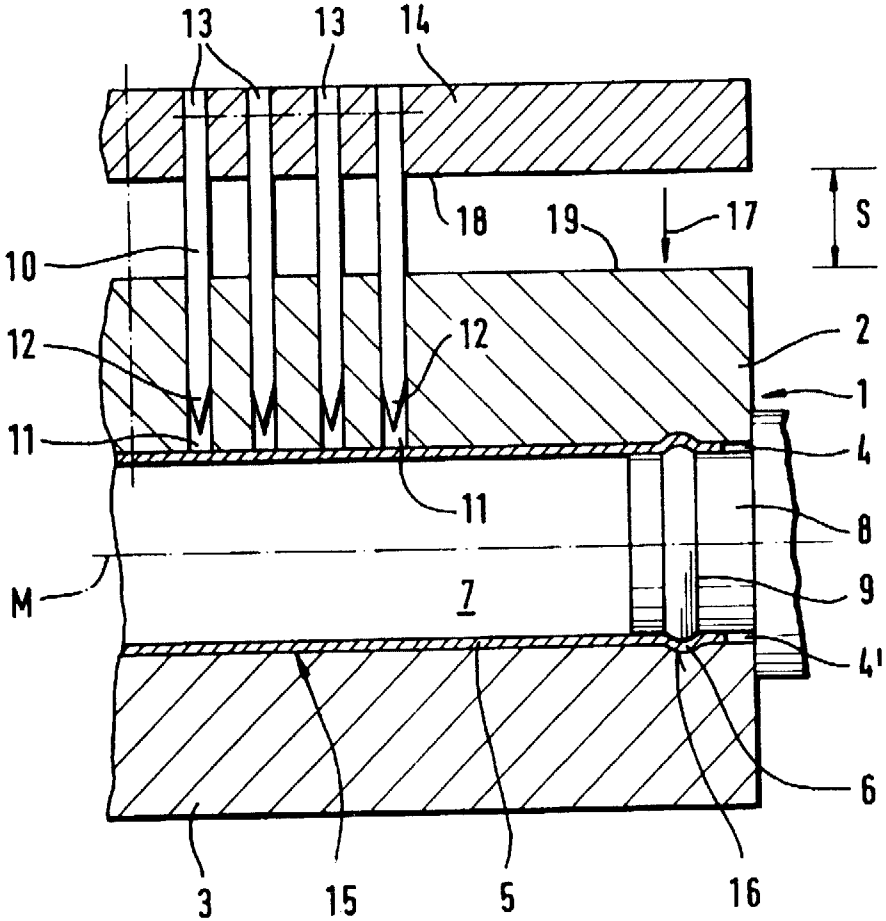
Figure 11:
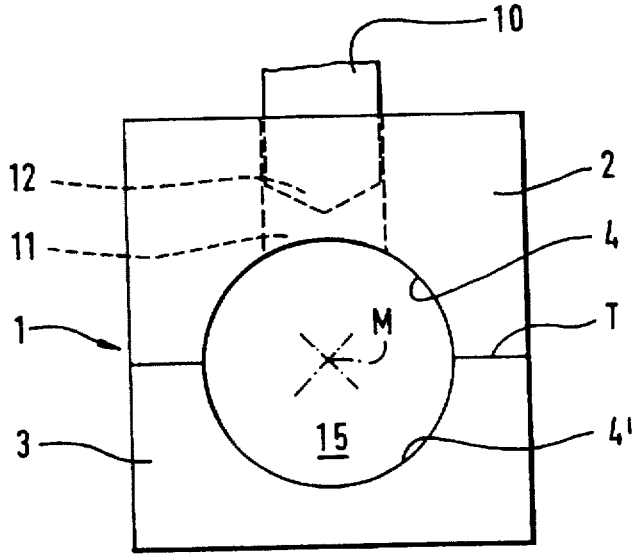
FIG. 11 shows an end view of the tool die without the header.

FIG. 1 shows a tool die 1, which comprises an upper member or tool part 2 and a lower member or tool part 3, each having a cavity 4, 4' respectively. These cavities 4, 4' together form a reception chamber 15 for a header 5. Preferably, the header 5 is a one-piece header, particularly a radiator for a motor vehicle. The parting plane of the tool die 1 extends at the height of the center line M of the header or of the reception chamber 15 formed by the cavities 4, 4'. An end view of the tool die 1 not containing a header is shown in FIG. 11. From this illustration, it can be seen that the cavity 4 in the upper tool part 2 and the cavity 4' in the lower tool part 3 are identical in design and together form the reception chamber 15 having a cylindrical shape. The parting plane T between the upper tool part 2 and the lower tool part 3 is at the same height as the center line M of the reception chamber 15.

Guide passages or openings 11 extend radially relative to the header 5 in the upper tool part 2. Punches 10 are guided in the openings 11 for longitudinal displacement. The punches 10 have a front or piercing end 12 lying a short distance from the reception chamber 15 or the wall of the header 5 positioned therein. The guide openings 11 and the punches 10 have an elongated cross-sectional shape having two flat parallely extending sides, as can be seen in FIG. 11 (which is turned through 90° relative to FIG. 1). Each of the punches 10 has an end portion 13 remote from the front end 12 and held in a pressure plate 14. Preferably, the pressure plate releasably fastens or clamps all of the punches so that the punches can be replaced or changed. The arrow 17 indicates the direction in which the pressure plate 14, together with the punches 10 fastened to it, makes a working stroke, the length of the maximum working stroke being designated S. This length S is determined by a distance between a contact surface 18 on the pressure plate 14 and a stop surface 19 lying opposite on the upper tool part 2.

Figure 2:
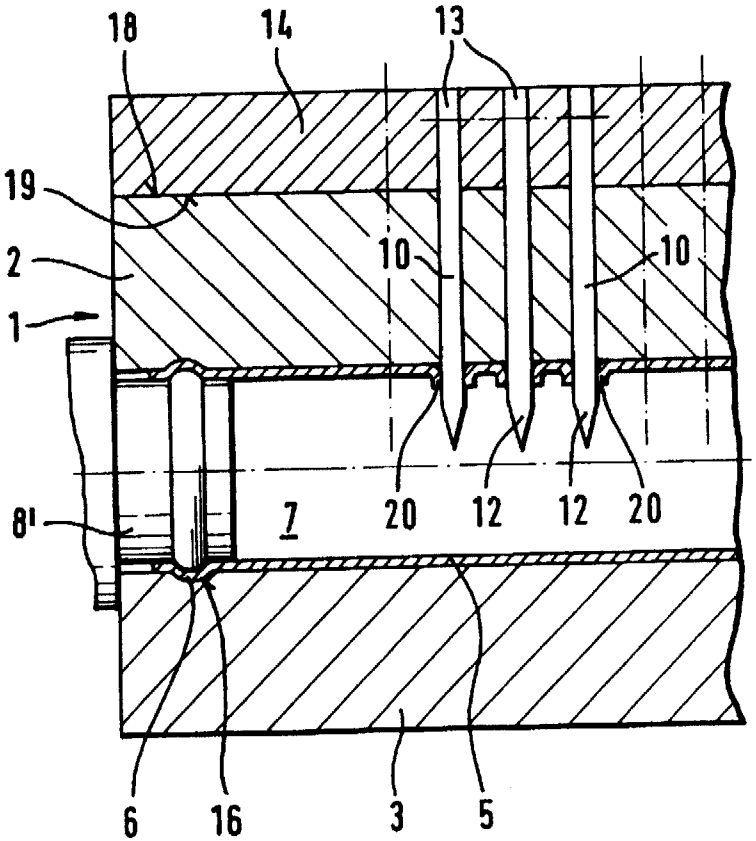
FIG. 2 shows a detail of the tool die with the punches pressed into the header.

FIG. 2 shows the opposite end of the tool die 1, together with the header 5 contained therein, in the state in which the front ends 12 of the punches 10 have penetrated into the interior 7 of the header 5. Before the pressure plate 14, together with the punches 10 fastened to it, makes the working stroke, the interior 7 of the header 5 is filled with fluid, pressurizing the fluid between 2 MPa and 50 MPa, preferably approximately 4 MPa to 10 MPa. This internal pressure supports the wall of the header 5 against the punches 10 acting radially on the header 5, so that the header wall substantially retains its shape and only the region of the openings to be formed is deformed.

The radial pressing-in of the punches forms an inwardly directed rim 20, which, because of the internal pressure in the header 5, bears against the peripheral surface of the punch 10 and remains in contact with it. Thus, no pressure fluid can pass out of the interior 7 on the penetration of the punches 10, so that the internal pressure is maintained.

Figure 3:
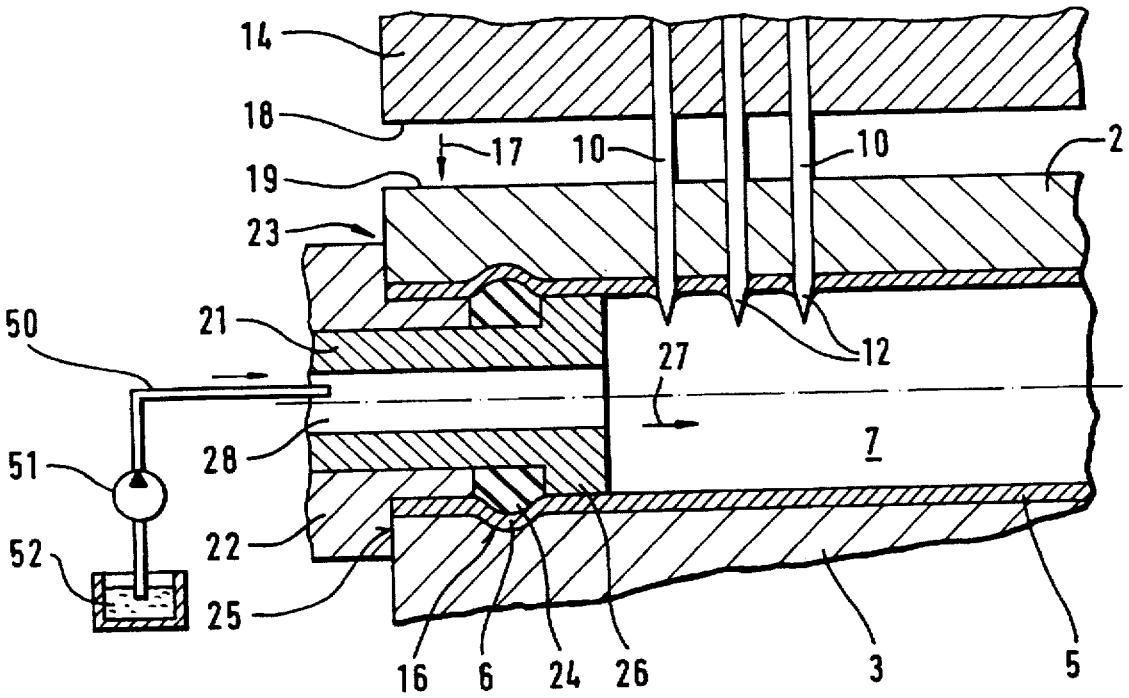
FIG. 3 shows a cross-section through the end region of the header, with a seal and a pressure medium connection.

FIG. 3 shows a section through the end portion of the header 5 during the pressing-in of the punches 10. Arranged here in the end of the header 5 is a stopper 23, which comprises an inner sleeve 21 and a support sleeve 22 arranged concentrically on the latter, as well as an annular element 24 of an elastic material, such as a rubber or a plastic material. The support sleeve 22 has a radial shoulder 25, by which the support ring 22 is supported on the tool die 1. The inner sleeve 21 extends through the support sleeve 22 and has a radial collar 26 lying inside the header 5, while the annular element 24 is arranged between the front end of the inner sleeve 21 and the radial collar 26. The support sleeve 22 is arranged for limited displacement in the direction of the arrow 27 relative to the inner sleeve 21. Thus, the distance between the radial surfaces loading the annular element 24 in the axial direction is increased. This corresponds to the state of the stopper 23 before it is inserted into the front end of the header 5. Since the annular element 24 is not loaded in this state, the annular element has a diameter corresponding to the inside diameter of the header 5. As the peripheral surfaces of the support sleeve 22 and the radial collar 26 of the inner sleeve 21 are also slightly smaller than the inside diameter of the header 5, the stopper 23 can easily be inserted until the radial shoulder 25 bears against the upper tool part 2 and the lower tool part 3.

An axial displacement of the inner sleeve 21, opposite to the direction of the arrow 27, subjects the annular element 24 to an axially directed load, so that the annular element 24 attempts to yield radially outwardly. Since, relative to the longitudinal direction of the reception chamber 15, the annular element 24 is situated in a plane in which the reception chamber 15 is provided with the annular depression 16, the force acting radially on the material of the header from the annular element 24 brings about an expansion of the header in the region of the depression 16, so that the header wall can be pressed into the depression 16 and the annular pressed-out ridge 6 is formed. This corresponds to the position shown in FIG. 3. The inner sleeve 21 has an axial pressure medium duct 28 connected to a pressure medium line 50 and through which pressure fluid can be fed from a reservoir 52 by means of a pump 51 into the interior 7 of the header 5. Apart from the pressure medium duct 28, the interior 7 of the header 5 is completely closed, so that the pressure necessary for the internal support of the header can be built up. Since, during the building-up of the pressure and the pressure retention phase, the stopper 23 is in the position shown in FIG. 3, the annular element 24 provides reliable sealing, preventing the pressure fluid from flowing out.

As soon as an adequate pressure has been built up in the interior 7 of the header 5, the pressure plate 14 is moved in the direction of the arrow 17, so that the front ends 12 of the punches 10 are driven into the header. Because of the internal pressure, the header wall is supported so that only the openings with the rims 20 surrounding them are formed. Before the pressure plate 14 and the punches 10 make a working stroke opposite to the direction of the arrow 17, the pressure in the header is relieved and the pressure fluid is optionally returned to an appropriate reservoir. Only thereafter are the punches 10 extracted from the header 5 and the tool die 1 opened, so that the header can be ejected from the tool die.

Figure 4:
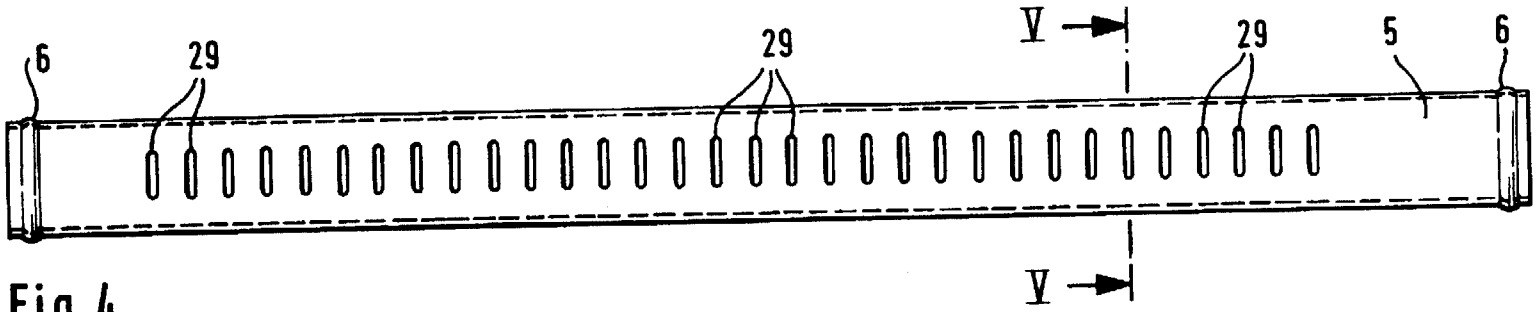
FIG. 4 shows a plan view of a header produced by the method according to the invention.

FIG. 4 shows a plan view of a header 5 having a pressed-out ridge 6 arranged near each end face of the header and also having a multiplicity of slit-shaped openings 29, which are spaced equidistantly, parallel to one another, at right angles to the longitudinal direction of the header. The distance between each outermost opening 29 and the respective end face of the header 5 can be selected as desired and is essentially determined by the installation conditions of the heat exchanger, the position and direction of the connection branches, and so on.

Figure 5:
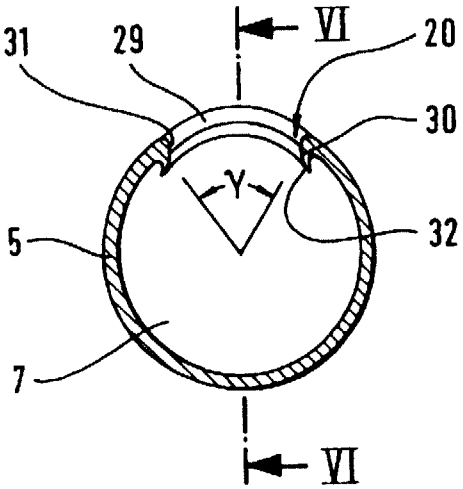
FIG. 5 shows on a larger scale a section taken along the line V—V in FIG. 4.

FIG. 5 shows a section taken along the line V—V in FIG. 4. It can be seen that the header 5 has a circular cross-section and that the opening 29 extends as a sickle-shape over a certain angle of arc in the header wall. In the exemplary embodiment the angle of arc $\gamma$ amounts to approximately 70°, but slit-shaped openings 29 having an angle of arc of up to approximately 150° are also possible. The rim 20, whose contour along the parallel side surfaces is likewise sickle-shaped, extends along the edge of the openings 29. While close to the outer peripheral surface of the header 5, the rim 20 has an outwardly widening contour, which may for example also be in the form of an insertion slope 31, and an inner peripheral surface 30 formed as a contact surface for a heat exchanger tube subsequently to be inserted. An edge or inner lip 32, situated radially inwardly of the rim 20, is in turn slightly widened, so that on the inside of the rim 20 a solder meniscus is formed on the heat exchanger tube subsequently inserted into the header 5.

Figure 6:
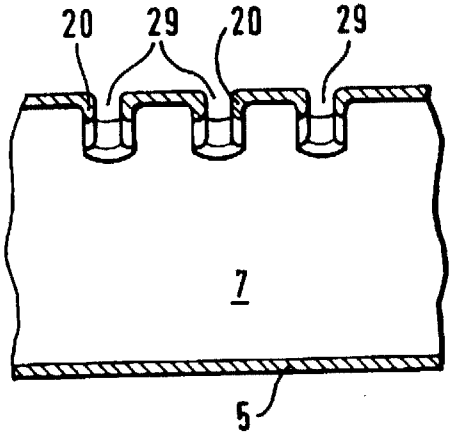
FIG. 6 shows a cross-section taken along the line VI—VI in FIG. 5.

FIG. 6 shows a section taken along the line VI—VI in FIG. 5. It can be seen that the external contour of the header 5 is completely level and is interrupted only by the openings 29 formed in the header wall. The rims 20 of the openings 29 have the same contour with surfaces 30 and the widened edge 32 directed toward the interior of the header, as already described in connection with FIG. 5.

Figure 7:
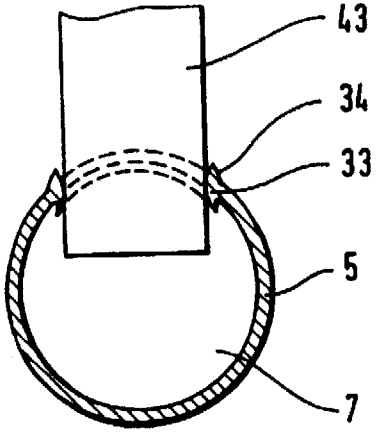
FIG. 7 shows another embodiment similar to FIG. 5.

FIG. 7 shows a variant of FIG. 5, with the and of a heat exchanger tube 43 inserted into the slit-shaped opening 29. A rim 33 surrounding the slit-shaped opening 29 has an upset or outer lip 34 projecting beyond the peripheral surface of the header wall. In contrast to FIG. 5, the rim 33 does not have a portion having parallel surfaces, but has an arched contour that bears against the peripheral surface of the heat exchanger tube 43. Both on the inner side of the header 5 and on the outer side, pronounced solder meniscuses are formed due to the shape of the rim 33.

Figure 8:
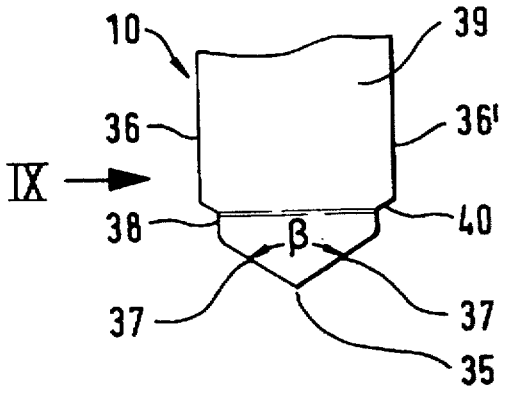
FIG. 8 illustrates the front end of a punch.

FIG. 8 shows the front end 12 of the punch 10, which end is formed on a punch stem 39 and has a point 35 provided with sloping surfaces 37 extending in the direction of the smaller sides 36, 36' and enclose between them an obtuse angle $\beta$. Adjoining the sloping surfaces 37 is a side portion 38 having an axial contour. This axial portion 38 has, at right angles to the longitudinal axis of the punch 10, a slightly smaller width than the that of the side surfaces between the smaller sides 36 and 36' of the punch stem 39. Between the portion 38 and the punch stem 39, a shoulder 40 is formed, which, depending on the desired contour on the outer side of the rim, has a more or less steep slope.

Figure 9:
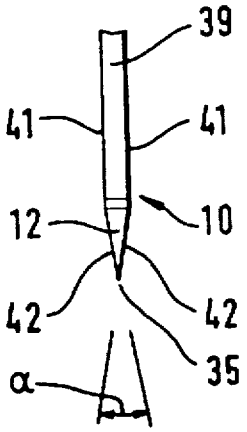
FIG. 9 is a view in the direction of the arrow IX of FIG. 8.

FIG. 9 shows a view in the direction of the arrow IX of FIG. 8. It can be seen that the punch 10 has a flat cross-sectional shape. The punch stem 39 is provided on parallel side surfaces 41 with bevels 42 extending to the point 35 and enclose between them an angle $\alpha$ less than 40°. In the exemplary embodiment shown in FIG. 9, the angle $\alpha$ amounts to approximately 20°.

The insertion slope 31 is produced during a residual stroke in the pressing-in of the punches, so that an additional operation is not required. That is, the punch first strikes the tip 35 against the wall of the header 5. As the punch stem 39 continues downward, the slot-like opening 29 is produced. The opening is completed when the side portion 38 is within the header wall. As the punch stem 39 moves another short distance further into the interior of the header 5, the shoulder 40 forces outwardly the short sides of the opening 29 as shown in FIG. 5 and thus produces the insertion slope 31.

Figure 10:
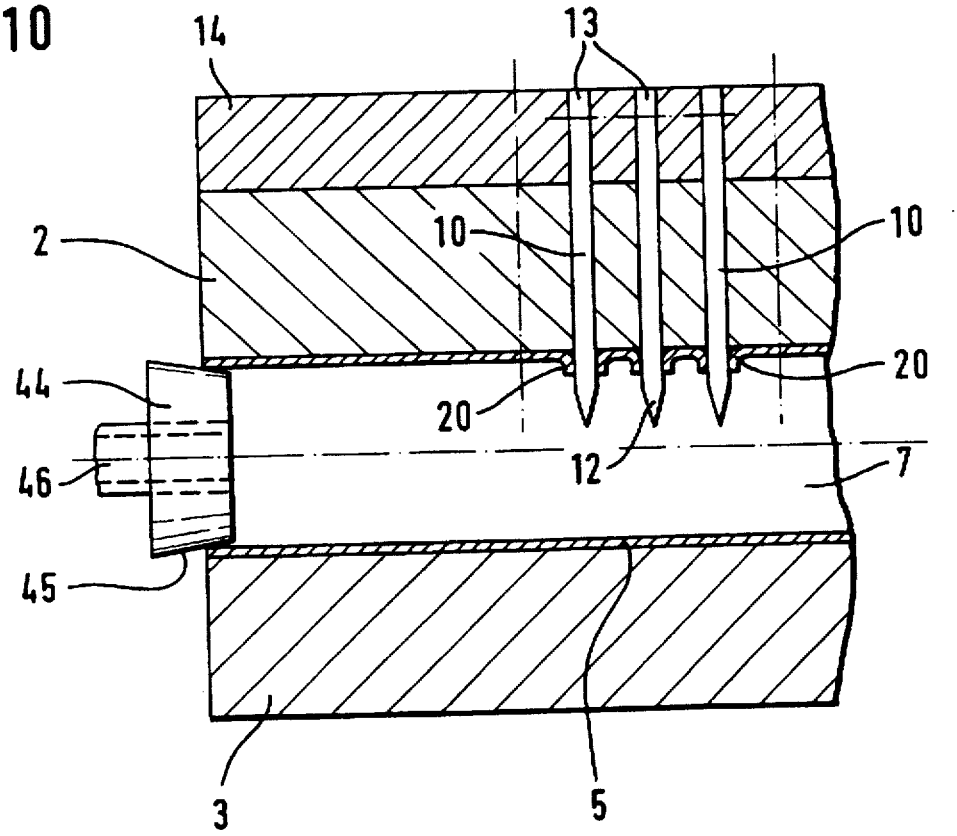
FIG. 10 shows another embodiment similar to FIG. 2.

FIG. 10 shows an arrangement similar to that in FIG. 2. To achieve pressure-tight closure of the header 5, a stopper 44 having a conical peripheral surface 45 is inserted into the header. When it is inserted into the end of the header 5, the stopper 44 self-centers and reliably closes the front end of the header. The stopper 44 is fastened on the end of a pressure medium line 46, so that the pressure medium line leads directly into the interior 7 of the header 5.

The essential advantages of the invention are seen in that, regardless of the shape of the header, support is simply provided in the interior of the tube by a fluid pressure, so that the contour of the header remains unchanged and undeformed. The openings produced in the wall of the header and the rims surrounding these openings have an extremely accurate contour, which corresponds to the outside perimeter of the heat exchanger tubes and brings about an enhancement of production quality in the manufacture of the heat exchanger. Since fluid is used to provide internal support when the punches are pressed into the header, no furrows or internal dies that have to be removed axially are needed.

Since the header is positioned in a tool die, it is also possible, after closing the tool die, to produce on the header, close to its end face, an annular pressed out ridge extending in the peripheral direction. Provided with a pressed-out ridge of this kind, the end of the header can serve at the same time as a hose connection for a coolant hose or the like. If a partition extending transversely to the longitudinal direction is arranged in the header, while one part of the header serves as an inlet and the other part as an outlet, both ends of the header can of course be provided with corresponding annular pressed-out ridges. These annular pressed-out ridges are preferably produced by compressing a plastic material, the pressing force of the plastic material acting radially outwardly, pressing the header wall into a corresponding recess in the tool die.

An adequate internal pressure is required to provide internal support for the header when the punches are pressed in, the level of the internal pressure being dependent on a number of parameters. The internal pressure may amount to between 2 MPa (20 bars) and 50 MPa (500 bars). The application of an internal pressure between 4 MPa and 10 MPa is preferable. To facilitate the insertion of the heat exchanger tubes into the openings in the header in the subsequent manufacture of the heat ex-changer, it is expedient to provide the openings with an insertion slope. These insertion slopes are preferably produced during a residual stroke in the pressing-in of the punches, so that an additional operation is not required.

The invention can be applied to headers of different cross-sections, although in practice cylindrical tube shapes should be of the greatest importance. It is therefore expedient for the reception chamber in the tool die to have a cylindrical shape. To enable the annular bead to be formed at the end of the header when the latter has been inserted into the tool die, an annular depression extending in the peripheral direction is provided, at a short distance from the end face of the header, at at least one end of the reception chamber.

To limit the number of relatively movable parts, the tool die is composed of two parts, an upper part of the tool and a lower part of the tool having two identical but mirror-inverted cavities, which together form the reception chamber. The punches are mounted in guide openings in the upper tool part, their mounting being as far as possible free from play, while only a lubricant film sufficient to lubricate the moving parts need be allowed. The actuating element for the punches is arranged on the side of the upper part of the tool remote from the lower part of the tool, and is preferably in the form of a pressure plate in which the punches are held non-positively in the direction of the working stroke. To limit the depth of penetration of the punches into the header, it is expedient for the length of the working stroke to be determined by the maximum distance between a contact surface of the actuating element and a stop surface of the upper part of the tool.

The shape of the openings in the header is determined in accordance with the cross-sectional shape of the heat exchanger tubes connected to the header. For heat exchangers having flat tubes, punches are, therefore, to be provided in the tool for producing the header, which have an elongated cross-sectional shape with parallel side surfaces and rounded smaller sides. For heat exchanger tubes having a round or oval cross-section the punch should obviously be shaped accordingly. To limit the expenditure of force for driving the punches into the header wall, it is advantageous for the front end of the punch to be in the form of a point having inclined surfaces extending to the rounded smaller sides of the cross-sectional shape. To achieve the most accurate possible cut in the header wall when the punch is driven in, a bevel directed toward the point should be provided on the side surfaces of the punch.

To achieve pressure-tight closing, it is not necessary to seal the tool die, but it is sufficient, for this purpose, to provide a stopper that can be inserted axially into the end of the header. A stopper of this kind may, for example, have a conical peripheral surface and preferably of a plastic or rubber material, at least in the region of the peripheral surface. Because of the conical peripheral surface, an accurate diameter is not required; a conical shape always self-centers until the peripheral surface of the stopper bears against the entire circumference of the header end. The stopper may, however, also be given a cylindrical shape and be provided with an annular seal. It is regarded as particularly expedient for the stopper to have an elastic annular element arranged between two loading elements on the end faces and to be radially expandable by an axial force. This allows sufficient play to exist and enable the stopper to be inserted into the end of the header; this radial play is overcome by the application of the axial force and a high pressure is produced to seal the interior of the header. Furthermore, this allows for a formation of a partial deformation of the header, for example, for forming the annular bead close to the end.

A pressure medium line fastened to the stopper is preferably used to supply the pressure fluid. The end of the pressure medium line can then be passed through the stopper and extended to the side of the latter facing the interior of the header. If the pressure medium line is not passed completely through the stopper, it is connected to the interior of the header via a bore in the stopper.

Given the disclosure of the present invention, one versed in the art would appreciate the fact that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

We claim:

1. A method of forming at least one opening through a tubular heat-exchanger header comprising the steps of:

inserting the tubular header into a tool die having a chamber dimensioned to receive the header, the chamber substantially conforming to an outer peripheral contour of the header;

providing at least one guide passage through the tool die for insertion of at least one punch, the guide passage exposing an area of the header to be pierced to form the opening in the header;

sealing the ends of the tubular header;

supplying fluid to the tubular header through one of the sealed ends and applying a predetermined internal pressure to a wall of the header with the fluid;

piercing through the header wall with the punch while the header is pressurized to prevent deformation of the header;

forming an inwardly directed rim around the opening during insertion of the punch through the header wall; and maintaining the pressure in the header during the piercing step by sealingly bearing the rim against the periphery of the punch.

2. A method according to claim 1, further comprising the steps of:

providing a plurality of guide passages through the tool die for insertion of a corresponding number of punches, the guide passages exposing areas of the header wall to be pierced forming a plurality of openings in the header; and simultaneously forming the openings, which are spaced longitudinally along the header, by piercing the exposed header wall areas with the punches while the header is pressurized, wherein the inwardly directed rim is formed around each opening in the header wall, and the pressure in the header is maintained during the piercing step by sealingly bearing each rim against the periphery of one of the punches.

3. A method according to claim 1, further comprising the steps of:

forming the chamber with an upper member and a lower member, the upper and lower members being closable to define the chamber; and forming an annular ridge extending in the peripheral direction close to each end of the header by axially compressing an annular element to produce a pressing force acting radially outwardly and pressing the header wall against a corresponding recess formed in the die tool.

4. A method according to claim 2, wherein the header is pressurized between 2 MPa and 50 MPa.

5. A method according to claim 2, wherein the header is pressurized between 4 MPa and 10 MPa.

6. A method according to claim 2, further comprising the step of forming an insertion slope on each of the rims with a residual stroke during the piercing of the punches, the insertion slope being adapted to guide a heat-exchanger tube to be inserted in the opening.

7. An apparatus adapted for forming at least one opening through a tubular heat exchanger header, comprising:

a tool die having a chamber dimensioned to receive the header, the chamber conforming to an outer peripheral contour of the header;

at least one punch adapted to pierce a wall of the header;

at least one guide passage through the tool die for insertion of the punch, the guide passage exposing an area of the header to be pierced for forming the opening in the header;

seals for sealing each end of the tubular header; and a fluid supplier for supplying fluid into the header through one of the seals and adapted to apply a predetermined internal pressure to a wall of the header with the fluid, wherein the punch is passed through the guide passage to pierce through the header wall to form the opening while the header is pressurized to prevent deformation of the header and is adapted produce an inwardly directed rim around the opening during insertion of the punch through the header wall, and wherein the pressure in the header is maintained, while the punch pierces the header wall, by the rim sealingly bearing against the periphery of the punch.

8. An apparatus according to claim 7, comprising a plurality of guide passages through the tool die, the guide passages being spaced in the longitudinal direction of the tool die, and a corresponding number of punches for piercing the header wall, the guide passages exposing areas of the header wall to be pierced, wherein a plurality of spaced openings in the header are formed by simultaneously piercing the exposed header wall areas with the punches while the header is pressurized.

9. An apparatus according to claim 8, wherein the tool die comprises an upper member and a lower member, the upper and lower members being closable to define the chamber, wherein the guide passages are in the upper member, and the upper and lower members are divided along the longitudinal direction of the header.

10. An apparatus according to claim 9, further comprising means for forming an annular ridge extending in the peripheral direction adjacent at least one end of the header, the annular ridge forming means including an annular element for producing a pressing force acting radially outwardly and a recess in the chamber, wherein the annular element is adapted to press the header wall against the recess.

11. An apparatus according to claim 10, wherein the chamber is cylindrical and adapted to receive a cylindrical header.

12. An apparatus according to claim 8, further comprising an actuating element connecting all of the punches to allow simultaneous movement of the punches for simultaneous formation of the openings.

13. An apparatus according to claim 12, wherein the actuating element comprises a pressure plate that holds all of the punches.

14. An apparatus according to claim 8, wherein each of the punches has an elongated cross-sectional shape with parallel sides and rounded smaller sides, and a front end of the punch has a point having sloping surfaces extending to the rounded smaller sides.

15. An apparatus according to claim 14, wherein each of the punches has an axial portion whose parallel sides are slightly shorter than those of a punch stem, and adjoins the sloping surfaces, forming a shoulder therebetween.

16. An apparatus according to claim 14, wherein each of the punches has a bevel directed toward the point and provided on the sides.

17. An apparatus according to claim 7, wherein the seals each comprise a stopper adapted for axial insertion into one end of the header.

18. An apparatus according to claim 17, wherein the stopper has a conical peripheral surface formed of a plastic material or rubber material.

19. An apparatus according to claim 17, wherein the stopper has a cylindrical shape and has an annular seal.

20. An apparatus according to claim 17, wherein the stopper has two end loading elements and an elastic annular element positioned between two end loading elements, the elastic annular element being radially expandable by the application of an axial force.

21. An apparatus according to claim 20, wherein the fluid supplier includes a pressure medium line fastened to one of the stoppers and a pressure medium duct therein connecting the pressure medium line to an interior of the header.

* * * * *